United States Patent [19]

Nishiyama et al.

[11] 4,392,269

[45] Jul. 12, 1983

[54] MOP CARRIER

[75] Inventors: Masanobu Nishiyama, Higashi; Fusao Kanazawa, Neyagawa; Hisaji Tanaka; Tatsuo Nishimura, both of Osaka, all of Japan

[73] Assignees: Duskin Franchise Kabushiki Kaisha; Kabushiki Kaisha Sunpack, both of Osaka, Japan

[21] Appl. No.: 240,827

[22] Filed: Mar. 5, 1981

[51] Int. Cl.[3] ..... A46B 17/02; A47L 13/24; B25G 3/04

[52] U.S. Cl. ..... 15/145; 15/146; 15/147 R; 15/148; 15/150; 15/176; 15/228

[58] Field of Search ..... 15/145, 146, 147 R, 15/148, 150, 178, 176, 228

[56] References Cited

U.S. PATENT DOCUMENTS

| | | | |
|---|---|---|---|
| 782,669 | 2/1905 | Lea | 15/176 X |
| 1,015,022 | 1/1912 | Harrison | 15/145 |
| 1,821,481 | 9/1931 | Schempp | 15/228 |
| 2,042,546 | 6/1936 | Meier | 15/228 X |
| 2,301,586 | 11/1942 | Rubin | 15/228 X |
| 2,703,424 | 3/1955 | Nicoli | 15/228 X |
| 2,739,330 | 3/1956 | Hitchcock | 15/176 |
| 2,835,914 | 5/1958 | Littleton | 15/145 X |
| 3,380,097 | 4/1968 | Pharris | 15/145 |

FOREIGN PATENT DOCUMENTS

| | | | |
|---|---|---|---|
| 2433140 | 1/1975 | Fed. Rep. of Germany | 15/176 |
| 431369 | 11/1911 | France | 15/176 |

*Primary Examiner*—Chris K. Moore

*Attorney, Agent, or Firm*—Cushman, Darby & Cushman

[57] ABSTRACT

A mop carrier is provided for mounting a mop and/or a brush to a mop handle. The mop carrier includes an elongated, continuous resilient blade having a first portion which extends downward at an acute angle, a second portion which curves around on itself and a third, straight portion which is horizontal and longer than the first portion. An upwardly open hollow cylindrical boss and connector are provided on the first portion near its outer end for mounting the mop carrier to the lower end of a mop handle. A hook is provided on the outside of the second portion for detachably retaining the loop of a mop that is sleeved on the third portion. And a set of flanges is provided on the third portion to permit a brush to be slidingly mounted on the third portion.

3 Claims, 15 Drawing Figures

MOP CARRIER

BACKGROUND OF THE INVENTION

1. Field of the Invention

This invention relates to a mop carrier, and more particularly the carrier device for mounting a mop, brush or the like for cleaning floors.

2. Description of the Prior Art

To date, mops or brushes integral with mop handles have been used but there has been need of frequent cleanings and washings of the mops or brushes since they pick up dirt and dust. However, those mop handles have been long, which has caused a difficulty in cleaning and washing and thereafter, and that has been quite inconvenient.

Furthermore, there have been many types of combinations of a mop with a straight handle with which a mop supporting element has been rotatably mated with a carrier. These conventional mops have had only sweeping function on the floor but no function for supporting the mop resiliently nor have they been insertable between desks and sofas and the floor for permitting cleaning of the floor thereunder.

SUMMARY OF THE INVENTION

To overcome such drawbacks, a primary object of this invention is to provide a mop carrier comprising a resilient semi-arcuate blade provided at the lowest position of a mop handle, said carrier comprising a first continuous portion, a second semi-arcuate curved continuous portion and a third straight continuous longer portion. With this resilient carrier, a user can insert the mop beneath desks, sofas, etc., to thoroughly clean the floor or corners of the room and collect dust, utilizing resilient energy, like with a broom.

One phase of this invention relates to a mop carrier, provided at a bottom of a mop handle, comprising a resilient blade comprising a first continuous portion, a second semi-arcuate curved continuous portion and a third straight longer portion.

A second phase of this invention comprises a carrier cap cylinder positioned below the bottom of the mop handle for detachably receiving the mop handle therein, a resilient blade extending in semi-arcuate form downwardly from said carrier cap a projective stage generally extending inwardly of said blade and a rotary member mounted onto said stage.

Another phase relates to the carrier having a hook member at its outer surface, on which a loop string from the mop is engaged.

Still another phase is to provide a cap means having a first and a second boss, and a cap which detachably grip the mop handle therein.

A still further phase and modifications will be apparent from the following description.

BRIEF DESCRIPTION OF THE ACCOMPANYING DRAWINGS

Figure 7A:
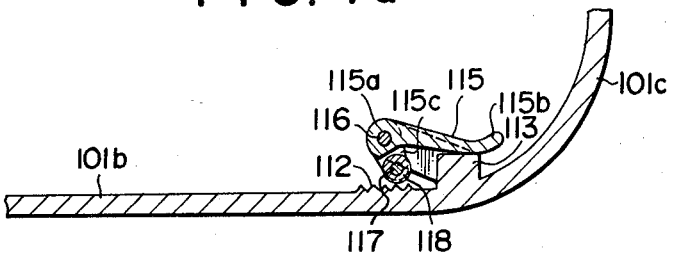
Figure 7B:
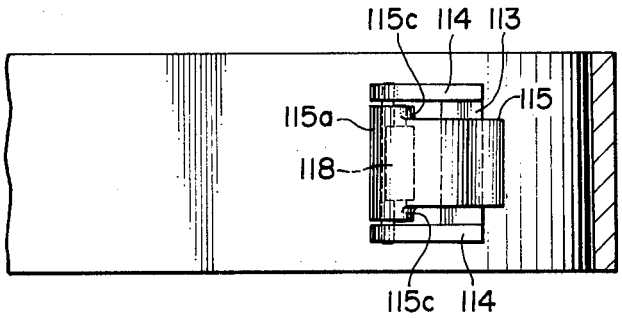
Figure 8:
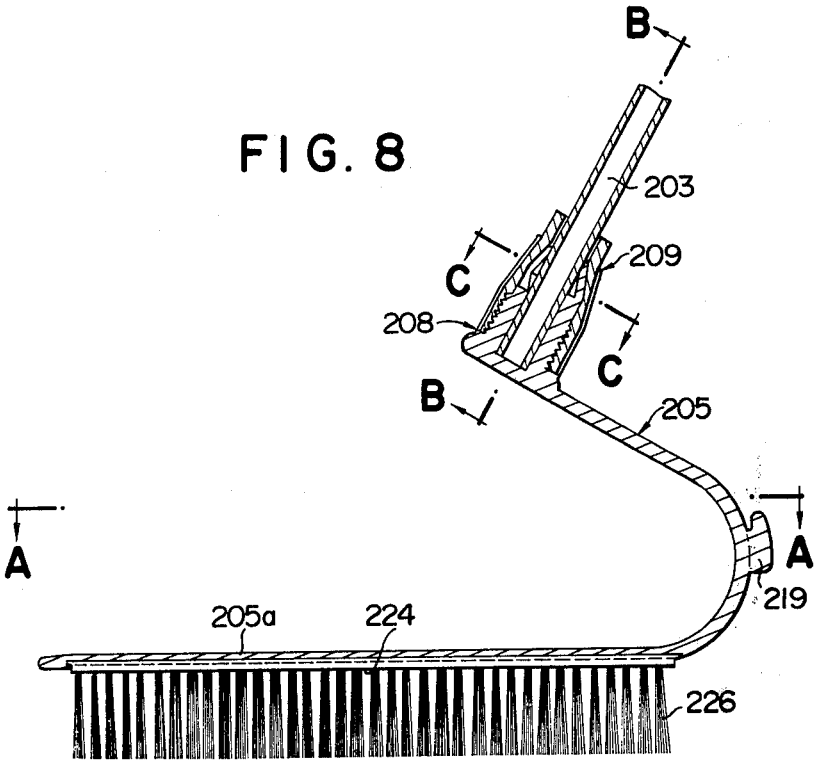
Figure 9:
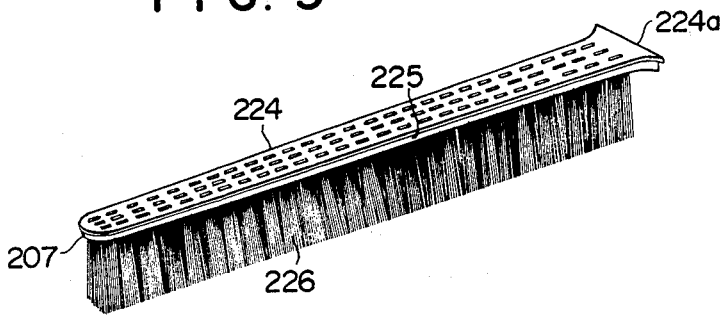
Figure 10:
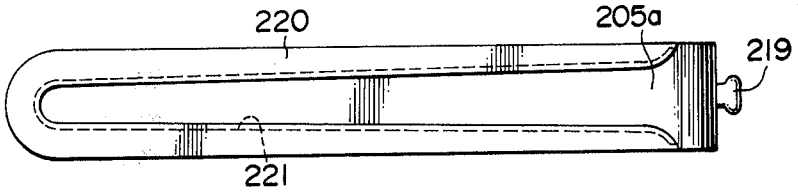
Figure 11:
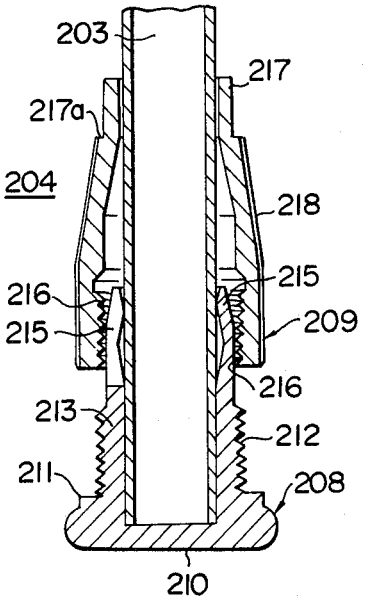
Figure 12:
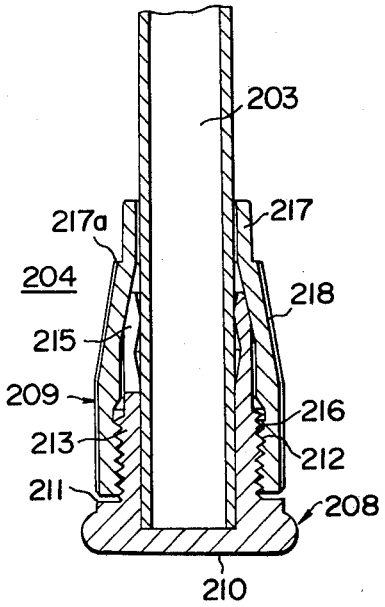
Figure 13:
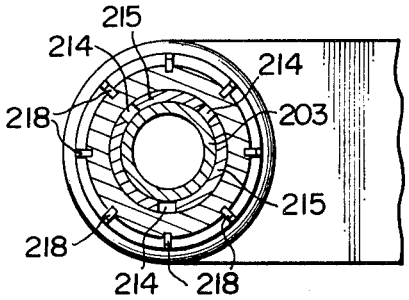
Figure 14:
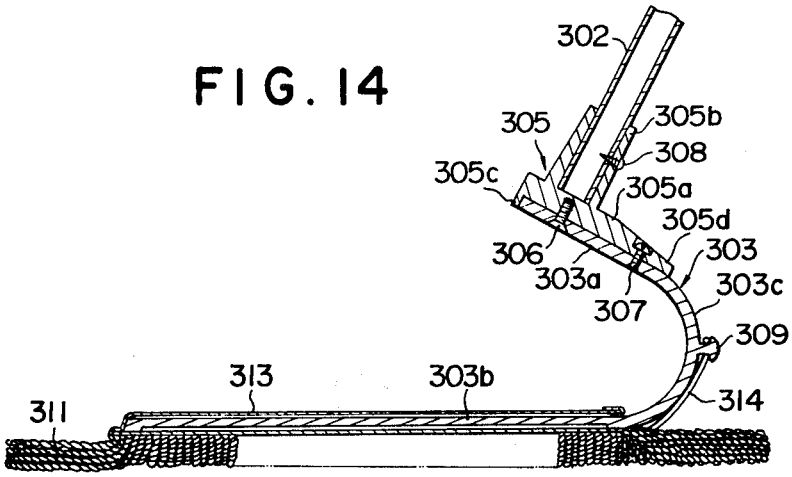

FIGS. 7(*a*) and 7(*b*) are side and plan views, respectively of the same embodiment;

FIG. 8 is a side view of a carrier device including a cap and blade and a brush attached thereto, and the mop handle;

FIG. 9 is a perspective view of the brush shown in FIG. 8;

FIG. 10 is a enlarged cross section taken along line A—A in fragmentary bottom plan view of the carrier of FIG. 8 with neither a brush nor a mop being carried thereby;

FIGS. 11–12 are fragmentary cross sections for functional explanation of the carrier cap, taken along line B—B in FIG. 8;

FIG. 13 is a fragmentary enlarged cross section along line C—C in FIG. 8; and FIG. 14 is a fragmentary longitudinal sectional view of the primary embodiment.

DETAILED DESCRIPTION

The preferred embodiment of this invention will be discussed with reference to FIG. 14.

The mop carrier 303 provided at a bottom 302 of a mop handle, comprises a resilient blade made of, for example, synthetic resin or the like, including a first continuous portion 303*a*, a second semi-arcuate continuous portion 303*c* and a third straight continuous longer portion 303*b*, the last of which is inserted into a mop sleeve 313.

The mop carrier 303 may be integral with and/or detachable from the mop handle.

More in detail, it is characterized in that a hollow connection cap 305 is mounted onto the bottom of the mop handle 302 with a screw 308, a bottom of said cap being extended with a right angle to the axis of the cap thereby forming an attachment plate member 305*a*, to which said first continuous portion is engaged with screws 306, 307.

As a modification, the bottom of the hollow cap 305 and the first continuous portion 303*a* may be integrally formed.

FIGS. 1–4 show another embodiment in which a mop carrier device 1 made of synthetic resin and the like materials is formed in a semi-arcuate V-shaped blade, which has a first continuous shorter portion 3, a second arcuate portion 9 and a third longer straight continuous portion 2. Provided integrally on the first portion 3 at its upper tip surface is a boss 5 which projects upwardly. This boss has a female thread 4 formed around its periphery, and also has, at its upper end, a plurality of, for example, three petals 5*a* which contiguously extend, and said petals are formed at the upper end periphery surface with tapered surfaces. Threadably mounted onto said boss 5 is a cap 7 for securing a mop handle therein which is formed in a hollow frusto-conical shape having a larger diameter at its bottom, on a periphery of which are provided male threads 8 and having at its middle portion inner surface having the same diameter as the tapered surface of the petals 5*a* and having at its upper inner extent a diameter essentially the same as the outer diameter of the mop handle 6.

Hence, upon idle-coupling of the mop handle into the cap 7 in advance and insertion of the handle 6 within the boss 5 and then threadable coupling of the cap 7 therewith, the petals 5*a* are pressed tightly onto the periphery of the handle 6 thereby realizing a perfect securement of the handle therewith. Secured integrally on the handle at its upper end is a grip 6*a*.

Figure 4:
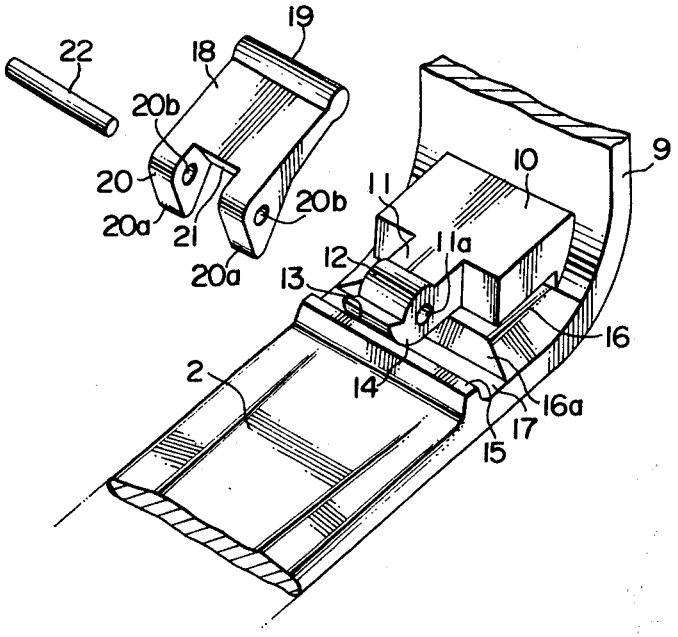
FIG. 4 is a fragmentary disassembled perspective view of the carrier.

As mentioned already, an arcuate portion 9 between the first shorter portion 3 and the straight portion 2 is provided. Inside of said portion 9 in parallel to the straight portion 2 is a protruded a stage portion 10 which is formed in a rectangular box shape and which has at its forward end a salient portion 11, as shown in FIG. 4 in a larger scale, in T-shape, in entirety. The salient nose portion 11 has a width generally one-third of the width of the stage 10 and a thickness the same as the stage 10, and at its front end, an arcuate portion 12. Protruded upwardly at a front end of said salient nose 11 is a step 13, from which an arcuate portion 14 continues downwardly much as a beak. A through bore 11*a* is provided at the salient nose in a transverse direction.

In front of said step 13 at a certain distance apart in opposed relation is a ridge 15 having a trapezoidal shape in cross section, along the width of the straight portion 2.

The stage 10 at its bottom has a further base 16 having a length from the arcuate blade portion 9 toward the midst of the salient nose 11. This base 16 has at its tip end a tapered surface 16*a*, and between the latter and the innerside surface of the ridge is provided a generally V-shaped groove gap 17.

A rotary member 18 is provided, having a width generally the same as the width of said stage 10 and having a loose V-shape in side view.

The one end of the rotary member 18 is formed so as to be gradually thinner toward the tip end, at which is formed a bent thick portion 20, at the center of which is formed a notch or cut 21, which has a width generally the same as the width of the salient nose 11. The cut 21 creates a pair of tip end finger portions 20*a*,20*a*, at both of its ends, through which is provided a through bore 20*b* in transverse direction on a same axis, each having a diameter which is the same as that of the bore 11*a*. The rotary member 18 sandwiches the salient nose 11 between its tip end fingers 20*a*,20*a* and is rotatably mounted on the latter with a pin 22 passing through the through bores 11*a*,20*a*. When attaching this rotary member 18 on the salient nose 11, a tip end cylindrical knob 19 is oriented toward the stage 10 and the end fingers 20*a* are inserted in the groove 17.

The mop 23 is fleece type fabric made on the base cloth 24 in an ellipsoidal thinner long shape. The sweeping fleece strings 25 are fixed onto the base cloth at their mid-portions by threads. On the upper surface of the cloth 24 is provided a cloth in essentially an identical shape with the base cloth 24, which is stitched along the periphery to provide a sleeve-shaped portion 26 having an opening 26*a*. The longer straight portion 2 of the carrier 1 is inserted into said sleeve portion.

Now, a method for using the carrier of this embodiment will be discussed.

First, the rotary member 18 is turned in the counterclockwise direction and thus the fingers 20*a* of the rotary member 18 are rotated from the ridge 15 toward the stage 10 at which time, the straight portion 2 of the blade is inserted into the sleeve 26 of the mop 23. At this moment, the opening end 26*a* of the sleeve portion 26 is positioned so as to be inserted between the stage and the base 16, as is clearly shown in FIG. 2. The opening end is easily and smoothly guided therebetween, when attaching the sleeve 26, since the surface from the front to the lower side is the arcuate portion 14.

Then, a rotation of the rotary member 18 in a clockwise direction presses at its fingers ends 20*a* an upper surface of the sleeve 26 near the opening 26*a* against the groove 17 and sandwiches the sleeve portion between the ridge 15 and the fingers 20*a*. Thus the sleeve, and hence the mop 23 are perfectly fixed to the carrier device 1. Then, the user can clean the floor with the mop 23 by pushing and pulling the mop handle 6.

Figure 1:
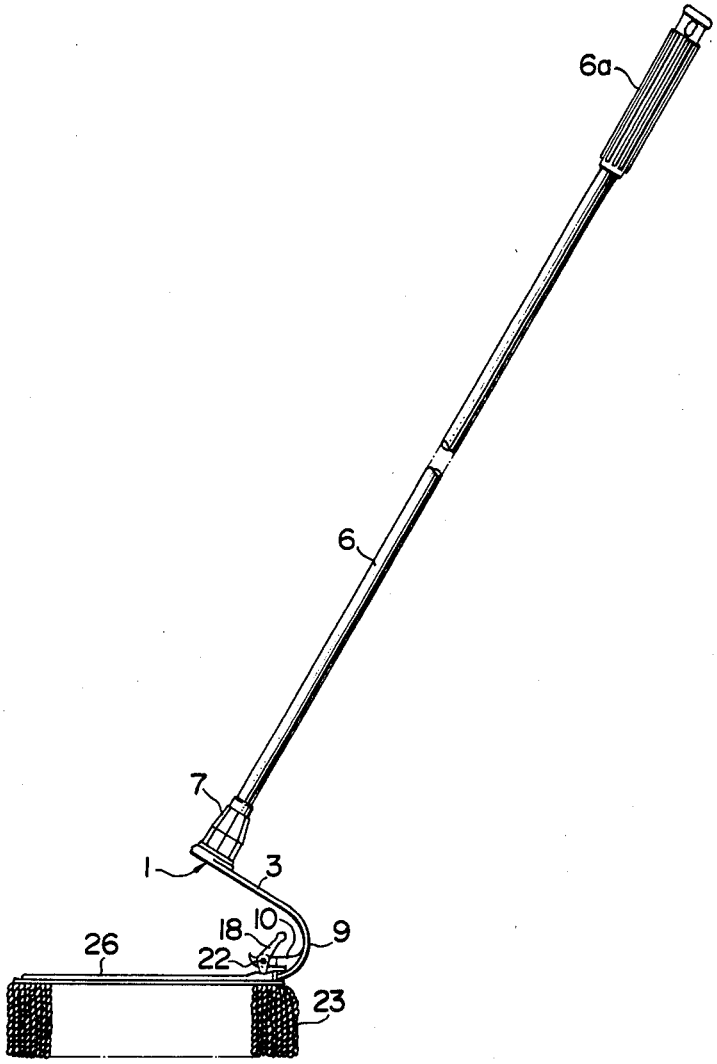
FIG. 1 is an overall side view showing the carrier member of one embodiment attached to a mop handle.
Figure 2:
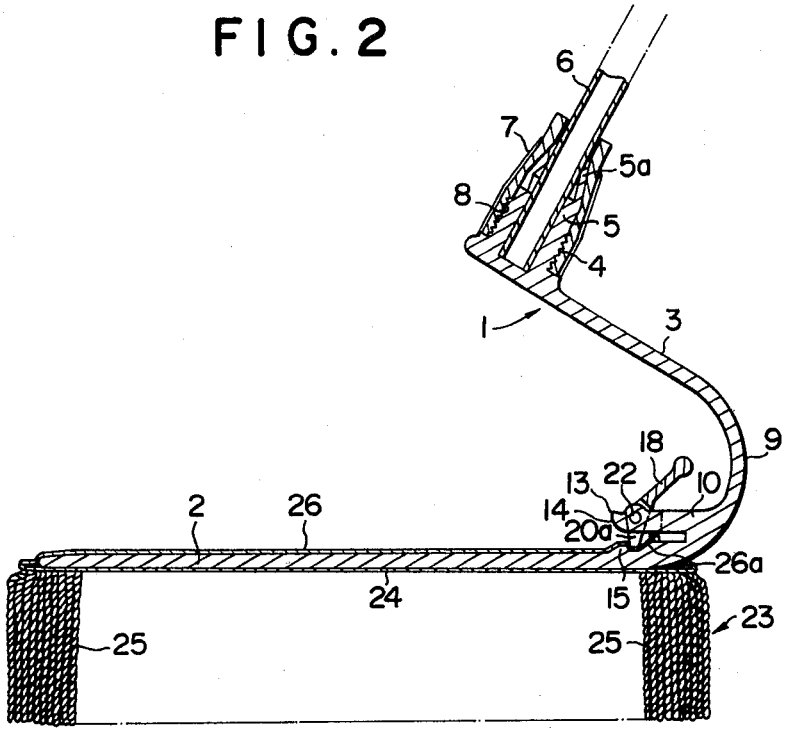
FIG. 2 is a longitudinal side cross section of the carrier.

When a force is applied in a direction where the mop 23 is pulled out the sleeve portion 26 is also pulled, but the rotary member 18 is rotated in a clockwise direction in FIG. 2 with a frictional force between the tip end of the fingers 20*a* and the sleeve portion, causing the fingers 20*a* to be strongly pressed against the ridge 15 and those thus more strongly fix the sleeve portion 26.

Figure 3:
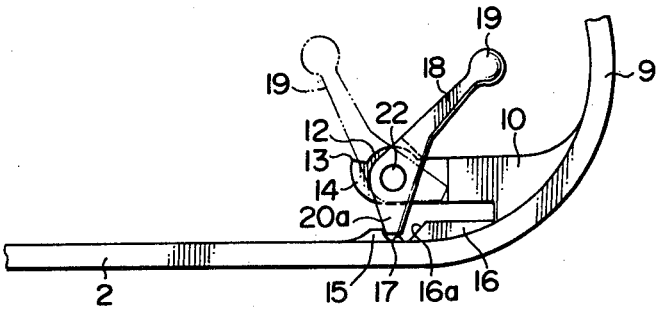
FIG. 3 is a fragmentary side elevation view of the carrier.

On the other hand, when the mop has become dirty and is to be exchanged, upon rotation of the rotary member 18 in a counterclockwise direction, its finger tip ends 20*a*, 20*a* contact the front end of the stage 10 as shown in a dotted line in FIG. 3 and those lower ends 20*a*, 20*a* become flush with the lower surface of the stage as shown in a dotted line in FIG. 3 and an engagement juxtaposed therewith is provided. Thus, the mop 23 is easily replaced without touching the rotary member 18 with fingers and a new mop is then placed in such a way that the opening end 26*a* of the sleeve 26 is easily inserted between the space of the lower surface of the stage 10 and the upper surface of the base 16.

Furthermore, when the opening end of the sleeve 26 positions between the lower ends of the stage 10 and the base 16, the tip end of the fingers 20*a*,20*a* of the rotary member 18 are frictionally rotated along the upper surface of the sleeve portion, even when the rotary member 18 is engaged by rotation of the same in a clockwise direction, and disengaged by rotating it in a counterclockwise direction.

This embodiment rather than being rotatably supported with the pin, could include provision of a pair of projection pins through the fingers and a tapered surface on each of the outer sides of the fingers, so that the finger pins sandwich the salient nose 11 and are inserted into the through bore of the latter. Of course, any other convenient bearing arrangement may be employed.

As is apparent from the above explanation, the user can easily detatch the mop by one finger press and rotation of the rotary member and attach it. Even when a force is effected for detaching the mop, the rotary member is caused to be rotated and sandwiches the sleeve portion with the base avoiding accidental pull-out of the mop when cleaning the floor and the rotary member is engaged at a position which does not prevent a passage of the sleeve of the mop, thus permitting an easy and convenient detachment and attachment of the mop.

Figure 5:
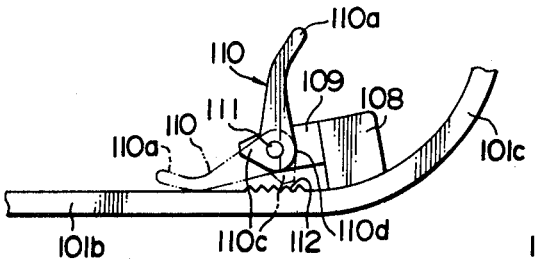
FIG. 5 is a fragmentary side view of another embodiment of the carrier.
Figure 6:
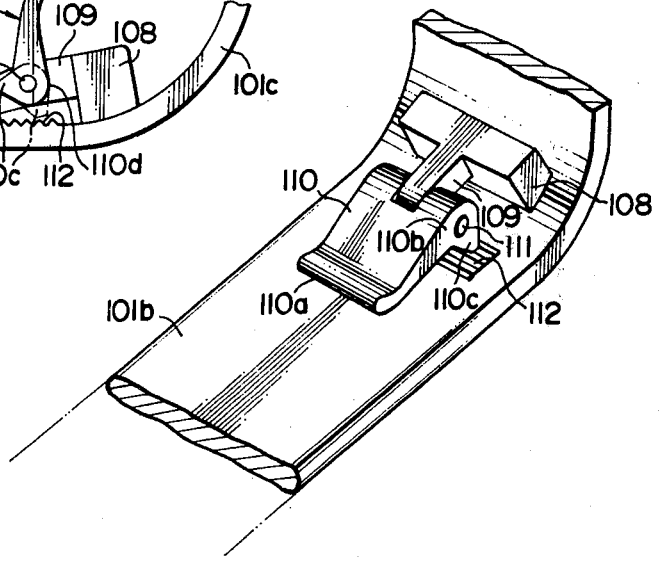
FIG. 6 is a fragmentary perspective view thereof.

The embodiment shown in FIGS. 5 and 6 comprises a rotary member 110 inside a stage 108 with a salient nose 109 in T-shaped form as seen in plan view. This salient nose has a transverse through bore, those being positioned inside the arcuate curved portion of the blade 101*b*, 101*c*. A rotary member 110 is rotatably mounted to sandwich the salient nose 109 with a pin 111, a plurality of ridges 112 being provided in the widthwise direction of the straight longer portion 101*b* of the blade beneath the lower tip end fingers 110*c* of said rotary member near its bearing portion, in opposite relation therewith. The fingers 110*c* function to sandwich the sleeve of the mop 5 between themselves and ridges 112 when the rotary member 110 is pushed down generally horizontally with the straight portion 101*b*. Such handling is made by one-touch finger push and or pull. This is a simple modification to the embodiment of FIGS. 1–4 and the major difference is the existence of washboard-like ridges 112 provided on the blade 101*b*, 101*c* in FIG. 5.

The stage 108 is uprightly provided on the straight portion 101*b* at its rightmost end. Inside the arcuate curved portion 101*c*, as shown in enlarged FIG. 6 the stage 108 is is formed in rectangular block. At its center and toward to the front end is formed a salient nose 109 which is angled slightly downwardly, so that both members form a T-shape. The rotary member 110 is rotatably pivoted onto the salient nose 109. The rotary member 110 is designed in a relatively V-shaped form and a portion near the salient nose 109 from the apex is thicker and another side is gradually thinner. The opposite portion 110 has a curved finger rest 110*a*. The thick portion apex 110*b* of the V-shaped form has a cut or notch which sandwiches said salient nose and rotatably pivoted therewith with a pin 111 at the respective through bore. Formed at the bottom portion of the one line of the V-shaped rotatable member are tip end fingers 110*c* and a line passing between said fingers 110*c* and a center line of the pin 111 is not perpendicular to the upper surface of the straight longer blade 110*b* when the rotary member 110 is turned onto the straight portion 110*b*, but at such a state that the lower ends of the fingers 110*c* incline toward the stage 108, as shown by a chain line in FIG. 5.

On the other hand, a plurality of ridges 112 each having a generally triangular shape in cross section, are provided opposite the thick apex 110*b* of the rotary member 110, on the upper surface of the straight longer portion 101*b*. These extend in a widthwise direction transversely of the blade.

When the finger tip ends 110*c* come in the nearmost position onto the upper end of the ridges 112 when the rotary member 110 has been turned down, the gap is slightly thinner than the thickness of said sleeve member 26. In other words, the lower fingers 110*c* are rotated describing an arcuate path, which is close to the ridges 112. The apex 110*b* has its outer surface from the apex toward the tip fingers, which is arcuate and concentric with the pin 111 and its both ends so as to make V-shaped form. As apparent from FIG. 5, when the free end of the rotary member 110 is rotated to come above, the fingers 110*c* leave the ridge 112 and the arcuate surface 110*d* comes in opposition to the ridges where the distance from the base end of the rotary member 110 and the ridges 112 becomes longest.

Now, use of the carrier of this modification will be hereinafter discussed.

First, the straight portion 101*b* of the blade is inserted into the sleeve opening of the mop 23. At this moment, the rotary member 110 is rotated about the pin 111 in a clockwise direction in FIG. 5 so that the free end of the curved knob 110*a* comes above as shown in FIG. 5. In this state, as the arcuate surface 110*d* of the rotary member and the ridges 112 are farther apart, the opening end of the sleeve member 26 of the mop can be quite easily and conveniently passed beneath the arcuate surface 110*d* and reaches a nearest position to the stage 108. Then, one finger push onto the arcuate portion 110*a* of the rotary member 110 gives a rotation in a counterclockwise direction in the figure, which then rotates the fingers 110*c*. These then begin to contact the sleeve member 26 on the ridges and when the line passing between the lowest portion of the fingers 110*c* and the center of the pin 111 run perpendicularly to a plane including the upper end portions of the ridges 112. In other words, when the distance between the ridges 112 and the fingers 110*c* becomes shortest, a so-called dead point state is realized, which permits the strongest pressing of the sleeve 26 onto the ridge 112. Upon further rotation of the rotary member beyond the dead-point in the counterclockwise direction, the fingers 110*c* escape toward the side of the stage 108 slightly beyond the dead point, as shown in FIG. 5 by a dotted line. However, the fingers 110*c* and the ridges sandwich strongly sack 26 as the both are closer and the sleeve remains between both without accidental escape. Hence, even if the user sweeps and cleans the floor using the mop with handle 6 and the mop is caught in the feet of a desk, etc., and the floor, there is no fear of decoupling of the mop from the carrier 101.

On the other hand, when detaching the mop 23, a reverse operation is made; a rotation of the rotary member 110 in a clockwise direction in the figure causes the fingers 110*c* to move beyond the dead point and leave the ridges 112 so as to push the sleeve 26 and when those are oriented generally in horizontal, the arcuate surface 110*d* is opposite the ridges 112 and the distance between the both members becomes longest and the sleeve 26 can easily be pulled-out passing beneath the rotary member 110, and thus the mop 23 can be detached.

In addition, as the free end of the rotary member is a curved knob 110*a*, the user can easily press it by finger and rotate the rotary member 110 essentially without touching the dirty sleeve of the mop.

FIGS. 7(*a*), (*b*) show a further modification of this invention and the like elements are designated by like numerals as used in FIGS. 5 and 6.

In this modification, the rotary directions are reversed from the above modification: side plates 114,114 are provided along the lengthwise direction of the straight portion 101*b* beside the stage 113 provided protrudingly on the latter.

The thick portion 115*a* of the rotary member 115 is borne rotatably between both ends of the side plates 114,114 with a pin 116. The free end of the rotary member is an upwardly curved finger rest 115*b*. Another end of the thick portion of the rotary member provides fingers 115*c* between which is rotatably held a roller 118 with a pin, those free end and the another ends forming a generally V-shaped form.

Upon counterclockwise rotation of the rotary member 115 in FIG. 7, the distance between the roller 118 and the ridges 112 becomes longest whereby the mop sleeve member 26 can be inserted easily therebetween. As may be understood from FIG. 7(*a*), the center position of the pin 117 which is the center position of the pin 116 and the roller 118 deviates horizontally and takes a position that the pin 117 is near to the stage 113.

Accordingly, when the finger rest underside of the rotary member contacts onto the stage 113, the distance between the roller 118 and the ridge 112 does not become longest, but in close proximity, and the mop sleeve 26 is surely sandwiched therebetween. Even when the rotary member 115 is turned, the roller 118 will never go beyond the dead point relative to the ridges 112, and the force tending to push out the sack 26 sandwiched therebetween is absorbed through the rotation of the roller 118, and hence the sleeve 26 is never pushed out and instead remains securely sandwiched.

Now, the a further embodiment will be hereinafter discussed with reference to FIGS. 8–13.

This carrier device comprises cap member 209 for receiving the mop handle 203 with a grip at 6*a* another end, said cap means being integrally provided with an arcuate V-shaped blade member 205 and with a hook 219, for hooking a loop string of the mop and/or brush 226. The cap member 209 is a hollow tubular member, its bottom having an inner diameter generally the same as the outer diameter of the mop handle. The cap has a first boss 208 including at its barrel outer face threads 212, its upper end being split into a plurality of petals which are integral with said blade 205, and a second boss 209 having at its inner lower end threads grooves or female threads matable with said first threads 212. The arcuate blade member 205 has a hook 219 at the outer side of its curved portion, and a longer straight portion 205*a*, which has a folded-back receiving periphery 220 at its underside for receiving the brush. The folded back receiver is of U-shaped form and its starting portion near the hook is open. Its other end is a continuous curve, as shown in FIG. 10, said receiving periphery having a groove 221 therein.

This carrier comprises an arcuate blade member 205 which is detachable on and from the mop handle 203 through the cap 204. The brush 207 or the mop is detachably mounted on the blade 205. The cap 204 is made from synthetic resin or like materials and it comprises a first boss 208 integral with the blade 205 and a second boss 209 mated with the former. The first boss 208 is formed on the tubular hollow member. Its bottom has its inner diameter generally the same as the outer diameter of the mop handle 203 and it has a shape like a Coca-Cola bottle, i.e. with a bottom with an expanded rim periphery in semi-arcuate in cross section with a larger diameter and a step 211 thereabove with a smaller diameter. The step 211 has at its upper surface a continuous barrel 213 having threads 212 from a certain distance inside the periphery of the stair. The barrel 213 has at its upper portion three grooves 214 at an equal distance. Therefore, the barrel is at its upper end split into three petals 215, each having an arcuate shape in cross section, the upper end of each being thinned slightly and inclined inwardly and its outer surface being tapered.

The second boss 209 is frusto-conical shape hollow cylinder, an outer diameter of the lower end of which is equivalent to the diameter of the step 211 of the first boss 208. Inside of this hollow cylinder are provided female threads 216 matable with said male threads 212. The second boss is thinned along the tapered surface having the identical tapered angle with the petals which are also tapered so as to be thinner along the surfaces upwardly and the upper end 217 being formed at the top, a length from the female threads 216 to the top 217 being slightly longer than the length of said petals 215. This second boss surface is slightly thinned and formed with a step 217*a*. A plurality of grooves 218 are formed on the outer surface of the second boss 209 from the bottom of the top portion 217, for preventing slippage.

Provided on the bottom surface of the cap 204, i.e. on the bottom surface 210 of the first boss 208 is a semi-arcuate blade 205 having a width generally identical with the diameter of the bottom 210. The blade 205 comprises a first flat continuous short portion, a continuous arcuate portion and a continuous longer straight portion 205*a*. The arcuate portion has at its outer side a hoop 219 in L-shape. Provided on the underside of the blade straight portion 205*a* is a thick fold-back 220 in U-shape, and its portion near the arcuate blade is open; the other end is continuous, so that the U-shape forms a guiding slit 221 for receiving the brush frame 224 therein.

As the blade 205 is arcuate, the mop handle 203 does not perpendicularly position with respect to the longer straight portion 205*a* but it is arranged so that its extended axial line reaches the center of the straight portion 205*a*.

The mop sleeve portion has its opening 26*a* as that of the previously described embodiment, and has at its one end a loop 314 as shown in FIG. 14, which is hooked on the hook 219 when the mop 23 is mounted on the straight portion 205*a*.

The brush 206 is formed on a base plate frame 224 which is tongue-shaped. Its total length is slightly shorter than the straight portion 205*a* and its width at its starting point 224*a* is essentially identical with the width of the blade 205*a*. It gradually narrows with a curve such as a curved U-shape and its bottom end is arcuate. On a periphery of the plate is a flange 225 having a thickness and a width for mating into the guiding slit 221. The brush 226 is attached on a bottom portion inside the said flange portion with a certain distance in a plurality of rows.

Now, a method for use of this embodiment will be discussed.

First, the mop handle is idly inserted into the second boss 209 of the cap 204 and then a lower end of the handle 203 is inserted into the first boss 208. The second boss is then mated onto the first boss 208. The second boss 209 is rotated and its inner female threads 216 and the male threads 212 of the first boss 208 are threadably engaged. The second boss 209 is deeply inserted and its inner tapered wall gradually and strongly presses the petals 215 against the mop handle 203 with the threadable advance. At this moment, in a state that the first and the second bosses 208,209 are securely threadably mated therewith, both bosses are constructed so that a gap is still provided between the lower end of the second boss 209 and the step 211 of the first boss 208 as shown in FIG. 12, whereby a stronger threadable mating is permitted and a completion of the threadable mating of the first and second bosses before the petals 215 sufficiently grip the handle 203 is prevented. Thus, the mop handle and the cap are mutually secured. If the brush is preferred for cleaning, as the case may be, the flange 225 of the brush periphery 207 is inserted into the guide slit 221*a* on the backside of the straight blade 205*a* of the cap 205. In this instance, as the brush plate 224 is formed in U-shaped form and its forward end is arcuate and narrower, it is easily inserted, and as the back end has a wider width essentially identical with the width of the guide slit 221, the brush 207 is securely received in the slit 221 with a force by hand.

The brush 207 is easily detached by pulling it out by hand.

When using the mop, the fleece strands type mop has a sleeve 26, and the straight blade 205*a* is inserted into said sack through the opening 26*a* at its one end. The loop 314 is hooked on the hook 219 for additional safety and thus accidental detaching of the mop is prevented even if the mop is caught by desk feet, etc. Only unhooking of the loop from the hook and pulling out of the blade 205*a* from the sleeve permits the detaching of the mop.

Thus, this embodiment permits an easy and quick detaching and attaching of the mop and/or brush, as the case may be, and the cleaning and washing of the mop or brush is so easy. The convenient and same mop-carrier permits a compatible usage for the mop and/or the brush and thus storage space is saved.

Now, the preferred will be further discussed, again with reference to FIG. 14.

This carrier device comprises a fixed hollow cap 305 and a resilient arcuate blade 303. The cap and the blade are fixed with screws 306 from the bottom. The cap has at its bottom an attachement plate integral therewith at a right angle thereto.

As like in the embodiment of FIGS. 8–13, the straight blade 303*b* is inserted into the mop sleeve 313 and the loop 314 from the mop is also hooked on the L-shaped hook provided on the outer side of the arcuate blade.

According to the above described embodiments, the user can conveniently clean the floor beneath desks and sofas with insertion of said mop attached on the arcuate resilient blade and also can detach and attach the carrier device with blade and/or the mop onto the mop handle and/or the mop carrier means with a one-touch finger work and detach it therefrom, as the case may be with simply the use of one finger to do the work.

We claim:

1. A mop carrier for removably mounting a mop and/or a brush to a mop handle;

said mop carrier comprising:

an elongated, continuous resilient blade including a first portion which at one end leads into a second, arcuate portion which at one end leads into a third, straight portion which is longer than said first portion and generally horizontal;

said first portion spacedly overlying said third portion;

means integrally providing an upwardly projecting cylindrical boss upon said first portion distally of said second portion, said boss having means defining an upwardly opening socket therein of a diameter to receive a mop handle lower end, said boss including a lower, barrel portion provided with a band of external threading, and being longitudinally split above said barrel portion into a plurality of angularly adjacent petals;

an internally threaded collar constructed and arranged to thread onto said boss and to radially inwardly urge said petals;

means providing a hook outwardly projecting on said second portion, said hook being constructed and arranged to detachably hold a mop loop for removably holding a mop sleeved on said third portion of said mop carrier resilient blade; and means providing a laterally directed flange means about two sides and an outer end of said third portion, whereby said third portion is constructed and arranged to longitudinally slidingly, removably receive a brush.

2. The mop carrier of claim 1, wherein:

said first portion extends upwards from said second portion at an included acute angle to said second portion and said cylindrical boss projects along a longitudinal axis which is arranged to intersect said third portion approximately mid-way along the length of said third portion.

3. A mop carrier for removably mounting a mop and/or a brush to a mop handle, said mop carrier comprising:

an elongated, continuous resilient blade including a first portion which at one end leads into a second, arcuate portion which at one end leads into a third, straight portion which is longer than said first portion and generally horizontal;

said first portion spacedly overlying said third portion;

means providing an upwardly projecting cylindrical boss mounted upon said first portion distally of said second portion, said boss having means defining an upwardly opening socket therein of a diameter to receive a mop handle lower end, said boss including a barrel portion;

means on said barrel portion for securing the boss to the mop handle lower end when the mop handle lower end is received in said socket;

means providing a hook outwardly projecting on said second portion, said hook being constructed and arranged to detachably hold a mop loop for removably holding a mop sleeved on said third portion of said mop carrier resilient blade; and means providing a laterally directed flange means about much of the perimeter of said third portion, whereby said third portion is constructed and arranged to longitudinally slidingly, removably receive a brush.

* * * * *